US005661258A

United States Patent [19]

Garcia et al.

[11] Patent Number: 5,661,258

[45] Date of Patent: Aug. 26, 1997

[54] AIR-DELIVERED ORDNANCE EXPLOSIVE MINE AND OBSTACLE CLEARANCE METHOD

[75] Inventors: Felipe A. Garcia, Panama City, Fla.; Robert C. Woodall, Jr., Pasadena, Md.

[73] Assignee: The United States of America as represented by the Secretary of the Navy, Washington, D.C.

[21] Appl. No.: 605,297

[22] Filed: Jan. 25, 1996

[51] Int. Cl.[6] ..... B63G 7/02

[52] U.S. Cl. ..... 102/402; 89/1.13

[58] Field of Search ..... 89/1.13, 1.11; 102/403, 402, 401, 406, 417

[56] References Cited

U.S. PATENT DOCUMENTS

| | | | |
|---|---|---|---|
| 3,064,568 | 11/1962 | Ainslie et al. | 102/403 |
| 4,185,554 | 1/1980 | Anderson et al. | 102/403 |
| 4,823,672 | 4/1989 | Eidelman | 89/1.13 |
| 5,042,387 | 8/1991 | Backstein | 102/402 |
| 5,437,230 | 8/1995 | Harris et al. | 102/302 |
| 5,524,524 | 6/1996 | Richards et al. | 89/1.13 |

FOREIGN PATENT DOCUMENTS 36 26 434 C3 2/1988 Germany .

*Primary Examiner*—Michael J. Carone
*Assistant Examiner*—Christopher K. Montgomery
*Attorney, Agent, or Firm*—Harvey A. Gilbert

[57] ABSTRACT

A method for air delivery of ordnance and clearing of explosive mines and obstacles from a navigable sea channel includes the step of providing quantities of ordnance adapted to survive impact with land and sea and prolonged immersion in sea water and to arm in response to air flow pressure and then detonate in response to receiving a preselected signal transmitted to the ordnance from a standoff location. The method also includes the step of delivering the quantities of ordnance through the air toward multiple sites in a navigable sea channel having obstacles and explosive mines therein so as to cause arming of the quantities of ordnance followed by impact thereof with the navigable sea channel and submersion and emplacement thereof at the multiple sites in the navigable sea channel. The air delivery method further includes the step of transmitting the preselected signal to and receiving the preselected signal by the emplaced quantities of armed ordnance so as to cause detonation thereof and the synergistic simultaneous destruction of the obstacles and explosive mines contained in the navigable sea channel. The method also preferably includes the step of marking an amphibious path through the cleared navigable sea channel.

16 Claims, 6 Drawing Sheets

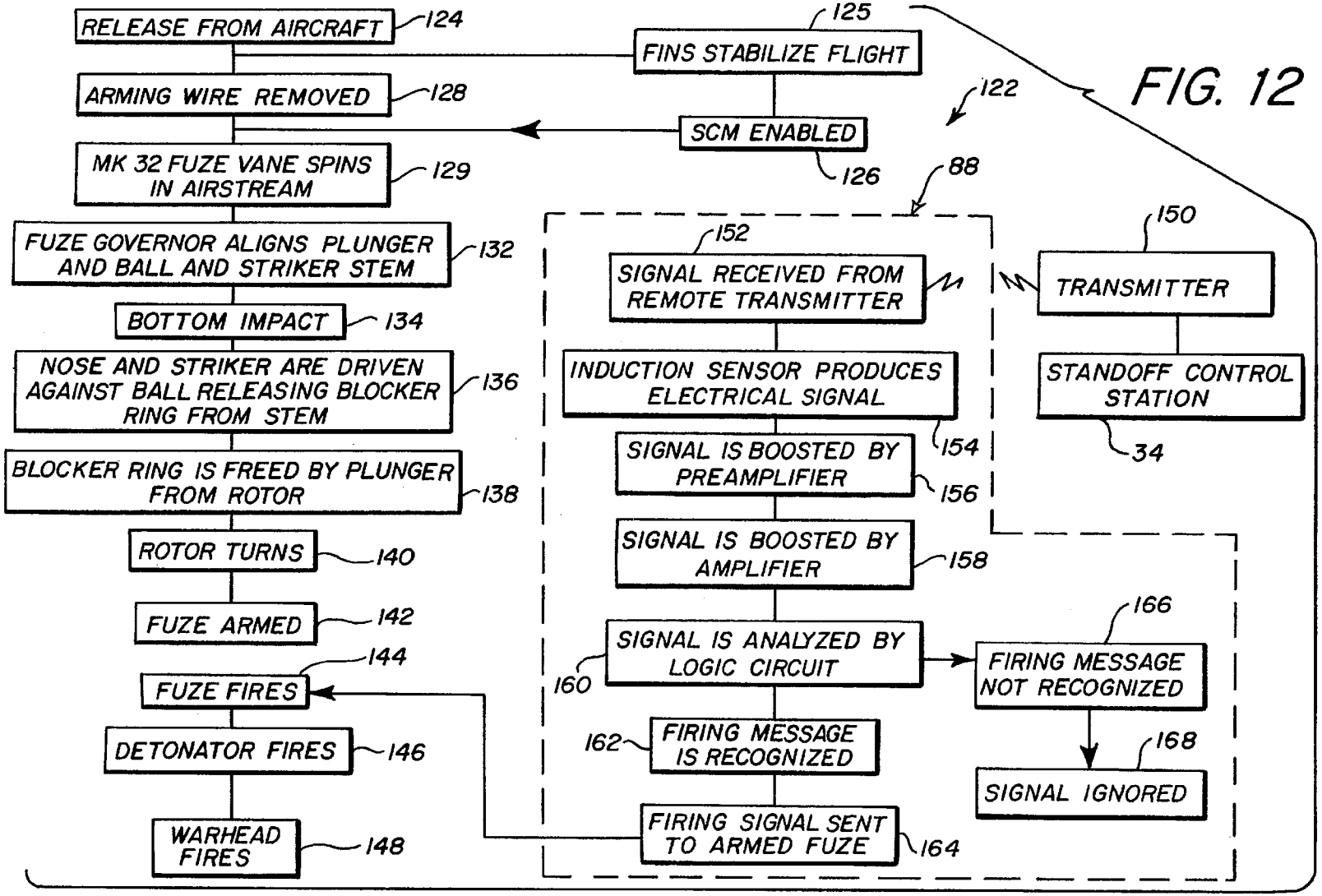
FIG. 12
122
125
FINS STABILIZE FLIGHT
126
SCM ENABLED
88
150
TRANSMITTER
STANDOFF CONTROL STATION
34
152
SIGNAL RECEIVED FROM REMOTE TRANSMITTER
INDUCTION SENSOR PRODUCES ELECTRICAL SIGNAL
154
SIGNAL IS BOOSTED BY PREAMPLIFIER
156
SIGNAL IS BOOSTED BY AMPLIFIER
158
SIGNAL IS ANALYZED BY LOGIC CIRCUIT
160
FIRING MESSAGE IS RECOGNIZED
162
FIRING SIGNAL SENT TO ARMED FUZE
164
FIRING MESSAGE NOT RECOGNIZED
166
SIGNAL IGNORED
168
124
RELEASE FROM AIRCRAFT
128
ARMING WIRE REMOVED
129
MK 32 FUZE VANE SPINS IN AIRSTREAM
132
FUZE GOVERNOR ALIGNS PLUNGER AND BALL AND STRIKER STEM
134
BOTTOM IMPACT
136
NOSE AND STRIKER ARE DRIVEN AGAINST BALL RELEASING BLOCKER RING FROM STEM
138
BLOCKER RING IS FREED BY PLUNGER FROM ROTOR
140
ROTOR TURNS
142
FUZE ARMED
144
FUZE FIRES
146
DETONATOR FIRES
148
WARHEAD FIRES

AIR-DELIVERED ORDNANCE EXPLOSIVE MINE AND OBSTACLE CLEARANCE METHOD

BACKGROUND OF THE INVENTION

1. Field of the Invention

The present invention generally relates to the clearing of obstacles and mines from navigable sea channels and, more particularly, is concerned with a method for air delivery of ordnance and clearing of explosive mines and obstacles in a navigable sea channel.

2. Description of the Prior Art

An amphibious assault operation is a dangerous military mission which can easily result in a high rate of casualties. At the present time, several approaches to small scale distributed explosive mine and obstacle clearing systems are being evaluated to support an amphibious assault operation. Such approaches under consideration include one-dimensional (discontinous line charges) and two-dimensional (detonating cord nets and miniature bomblet arrays) systems.

However, such approaches appear to have several shortcomings. First, they require obstacles to be removed or substantially diminished prior to using such systems in mine clearance operations. Second, such approaches are limited in scale and lack the tonnage necessary for simultaneous obstacle and mine clearing in an over-the-horizon amphibious assault. Third, such small scale distributed explosive mine clearing systems may require significant amounts of time, numerous sequential deployments, and still may not create a safely cleared assault lane of adequate dimension for the fleet to safely traverse. Fourth, such small scale systems require the development of lane marking devices. In view that many of the small scale mine clearing systems, as well as channel marking devices, can only be used safely and effectively once the beach area is secured by friendly forces, their use by amphibious forces advancing by sea to the beach is not feasible. Fifth, current systems require amphibious forces to come into range of enemy fire for an extended period of time in order to deploy such current systems.

Consequently, a need still exists for an explosive mine and obstacle clearing method and additionally for a channel marking method for facilitating an amphibious assault which will overcome the shortcomings of the prior art without introducing new ones in their place.

SUMMARY OF THE INVENTION

The present invention provides a method for air delivery of ordnance and clearing of explosive mines and obstacles in a navigable sea channel which is designed to satisfy the aforementioned need. The method of the present invention also may incorporate steps to provide for visible marking of an amphibious path through the cleared navigable sea channel. The method provides a large scale clearing capability and an over-the-horizon capability having the speed and brute force necessary for a rapid effective amphibious assault that will minimize exposure to enemy fire, reduce casualties (both personnel and hardware), and free up amphibious assets for other critical missions. Also, detonation of the ordnance so emplaced will create a sensor visible navigable sea channel.

Deployment of the ordnance would be by high speed aircraft accurately emplacing bulk quantities of ordnance to cover the navigable sea channel. The ordnance which can readily be used are mines presently in inventory which are modified to support initiation of their warheads by a remotely generated encrypted magnetic signal. The magnetic signal will detonate simultaneously all of the emplaced ordnance. Such synergistic detonation of the bulk ordnance will result in the destruction of enemy mines and the clearance of emplaced obstacles at a reduced ordnance weight, by several orders of magnitude, as compared to the use of smaller scale systems and the sequential detonation of explosives. Reducing the amount of explosive necessary for clearance operations in this manner will result in fewer sorties being needed for the mission as compared to sortie missions employing sequentially detonated bombs.

Accordingly, the present invention is directed to a method for air delivery of ordnance and clearing of explosive mines and obstacles from a navigable sea channel. The method comprises the steps of: (a) providing quantities of ordnance adapted to survive impact with land and sea and prolonged immersion in sea water and to arm in response to air flow pressure and then detonate in response to receiving a preselected signal transmitted to the ordnance; (b) delivering the quantities of ordnance through the air toward multiple sites in the navigable sea channel containing obstacles and explosive mines so as to cause arming of the quantities of ordnance followed by impact thereof with the navigable sea channel and submersion and emplacement thereof at the multiple sites in the navigable sea channel; (c) transmitting the preselected signal; and (d) receiving the preselected signal at the emplaced quantities of armed ordnance so as to cause simultaneous detonation thereof and synergistic destruction of the obstacles and explosive mines in the navigable sea channel.

The preselected signal preferably is a magnetic signal transmitted simultaneously to all of the emplaced quantities of armed ordnance from a transmitter located at a standoff control station. Further, the quantities of ordnance are delivered by aircraft or, alternatively, from a standoff delivery platform. Also, the method can further comprise the step of delivering global positioning system markers with the quantities of ordnance to mark an amphibious path through the cleared navigable sea channel.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 12 is detailed flow diagram of the method of the present invention.

DETAILED DESCRIPTION OF THE INVENTION

Overview of the Invention

Figure 1:
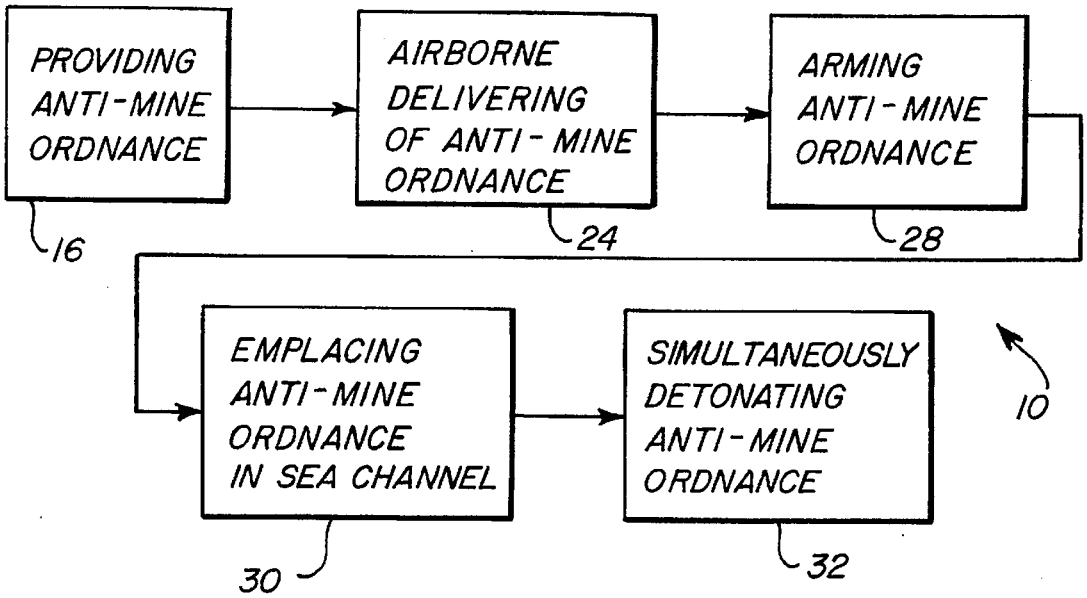
FIG. 1 is a general flow diagram of a method for air delivery of ordnance and clearing of explosive mines and obstacles from a navigable sea channel in accordance with the present invention.
Figure 2:
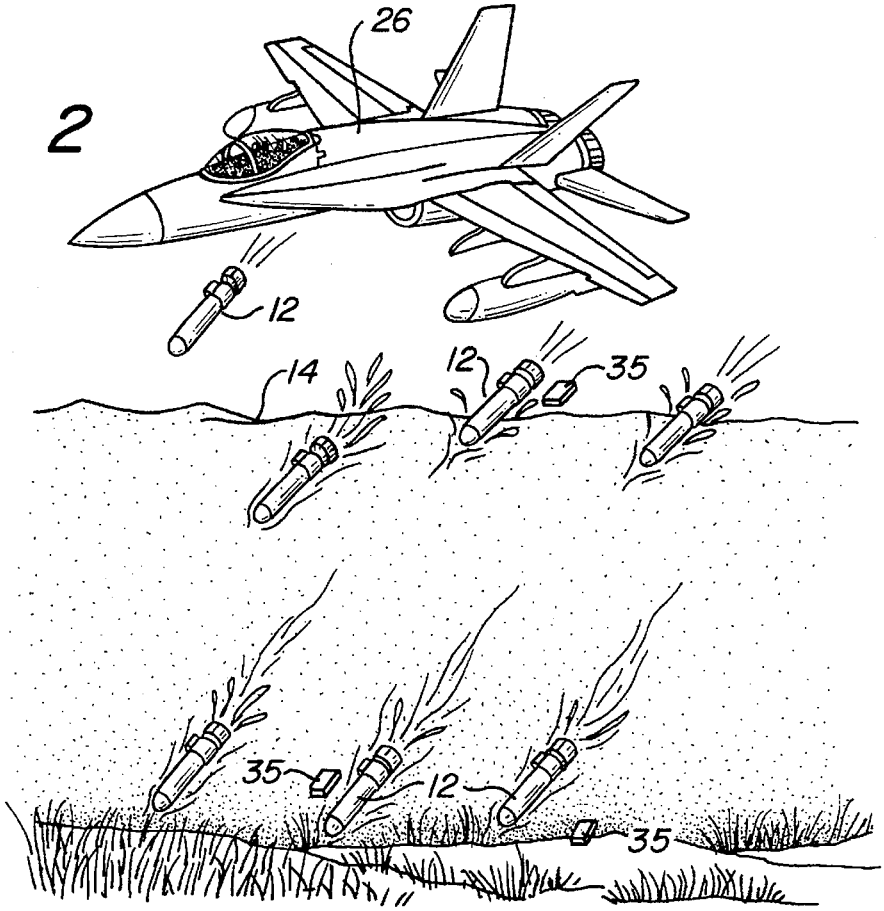
FIG. 2 is a perspective view of an aircraft delivering a quantity of ordnance toward multiple sites in a navigable sea channel in accordance with the method of the present invention.

Referring now to the drawings and particularly to FIG. 1, there is illustrated in a general flow diagram, generally designated 10, the basic steps of the method of the present invention for air delivery of ordnance 12 and for clearing of explosive mines and obstacles (not shown) from a navigable sea channel 14 shown in FIG. 2. As one representative example, the sea channel 14 can be an amphibious assault lane extending from shallow water to a craft landing zone on a beach.

As per block 16 of the flow diagram 10, the required quantities of anti-mine ordnance 12 provided for emplacement in and clearing of the sea channel 14 can come from a family of prior art mines 18, 20, 22, as depicted in FIGS. 3–8, that are presently in the inventory of the U.S. Government. These ordnance are converted for employment in an anti-mine mode in the method of the present invention. As per block 24 of the flow diagram 10, this family of ordnance 12, commonly referred to as Quickstrike mines, are designed to be delivered from high speed aircraft 26, as seen in FIG. 2, and are adapted to survive land or water impact and to remain functional after prolonged immersion in sea water. As an example, a total of eleven FA-18 sorties might be needed in order to deliver all ordnance required to clear an adequate lane for navigation through the surf zone. Such a mission would require the high speed aircraft 26 to deliver the modified Quickstrike ordnance 12 through air by dropping the ordnance 12 along a predetermined path ahead of amphibious forces toward multiple sites in the sea channel 14 containing various obstacles and explosive mines. As per block 28 of the flow diagram 10, the pressure of air flow against the ordnance 12 causes the arming thereof, which is then followed by impact with the navigable sea channel 14 and submersion and emplacement, as per block 30 of the flow diagram 10, at the multiple sites in the navigable sea channel 14. As per block 32 of the flow diagram 10, the armed and emplaced quantities of ordnance 12 are then detonated simultaneously with one another in response to receiving a magnetic signal transmitted to the ordnance 12 from a suitable standoff control station 34 (see FIG. 12). Such simultaneous detonation will cause complete destruction of the obstacles and explosive mines in the navigable sea channel 14.

Therefore, prior to landing of initial military assault elements, the sea lane would be cleared by simultaneous detonation of the Quickstrike warheads using a magnetic signaling device aboard any of a number of airborne or sea going platforms. Amphibious forces would then navigate the cleared lane and land on the beach. In addition, in accordance with the method of the present invention, global positioning system markers 35 (FIG. 2) can be employed with the quantities of ordnance 12 so that the amphibious path through the cleared navigable sea channel is visibly marked prior to system detonation.

PREFERRED EMBODIMENT OF INVENTION

Referring now to FIGS. 3–8, there is illustrated the family of prior art Quickstrike mines 18, 20, 22 that are presently in the munitions inventory of the U.S. Government (known as MK 63/64/65) and thus are available for employment in the method of the present invention. These ordnance 12 are converted for employment in the anti-mine mode in the method of the present invention by making their signal receivers responsive to a preselected specific encrypted magnetic signal transmission, instead of the usual near field signals generated by a submarine or ship which these ordnance would ordinarily respond to when functioning in their usual explosive mine mode.

Figure 3:
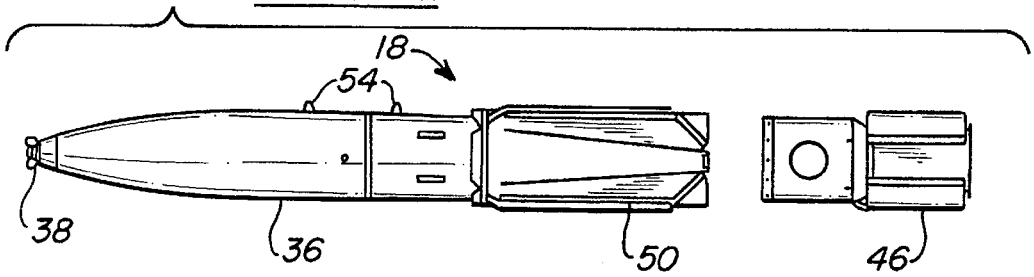
FIG. 3 PRIOR ART
FIG. 3 is a side elevational view of one prior art mine adapted to provide the ordnance used in the method.
Figure 4:
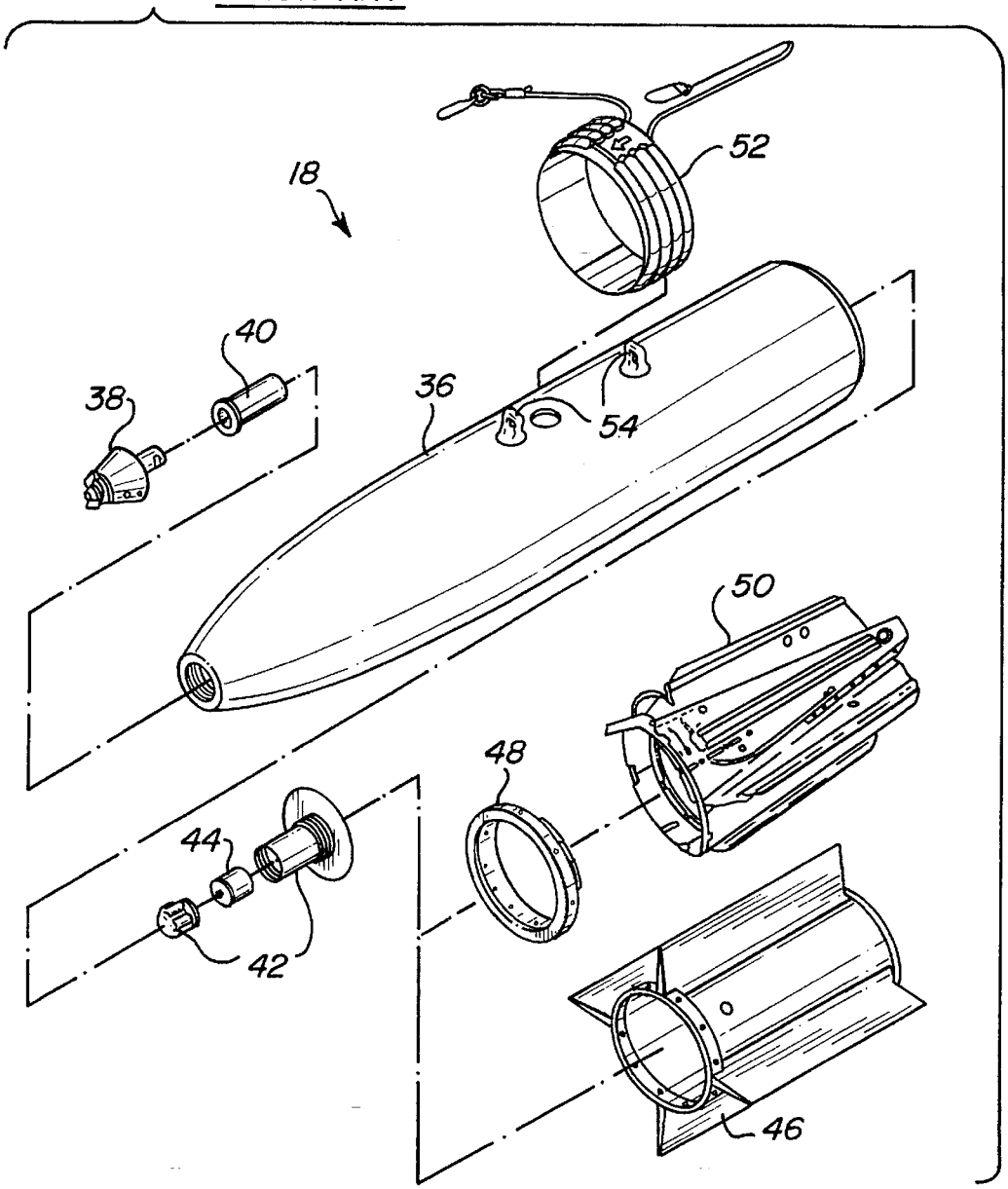
FIG. 4 PRIOR ART
FIG. 4 is an enlarged exploded perspective view of the prior art mine of FIG. 3.

Referring to FIGS. 3 and 4, the MK 63 Quickstrike ordnance 18 is a warhead weighing 500 pounds. As well-known, the MK 63 ordnance 18 includes an elongated bomb case 36 having an arming device 38 and booster 40 mounted at its nose end and a target detecting device 42 and battery 44 disposed in the bomb case 36. At the rear end of the bomb case 36 is supported a tail section 46, bomb fin adapter 48 and bomb fin 50 in succession. Also, a cable and strap assembly 52 encircles the midsection of the bomb case 36 between a pair of axially displaced hook eyelets 54 attached thereon.

Figure 5:
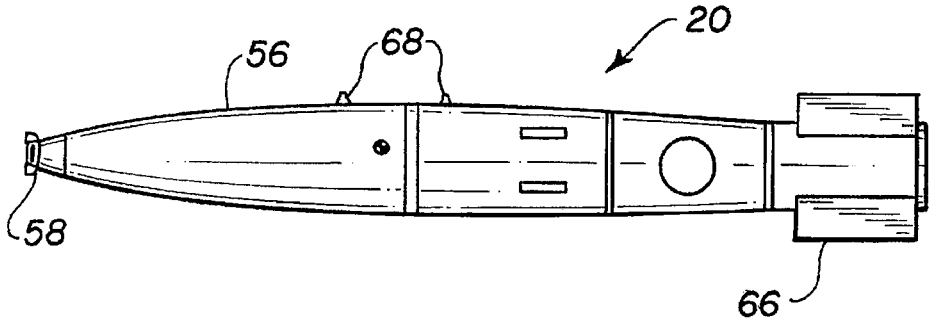
FIG. 5 PRIOR ART
FIG. 5 is a side elevational view of another prior art mine adapted to provide the ordnance used in the method.
Figure 6:
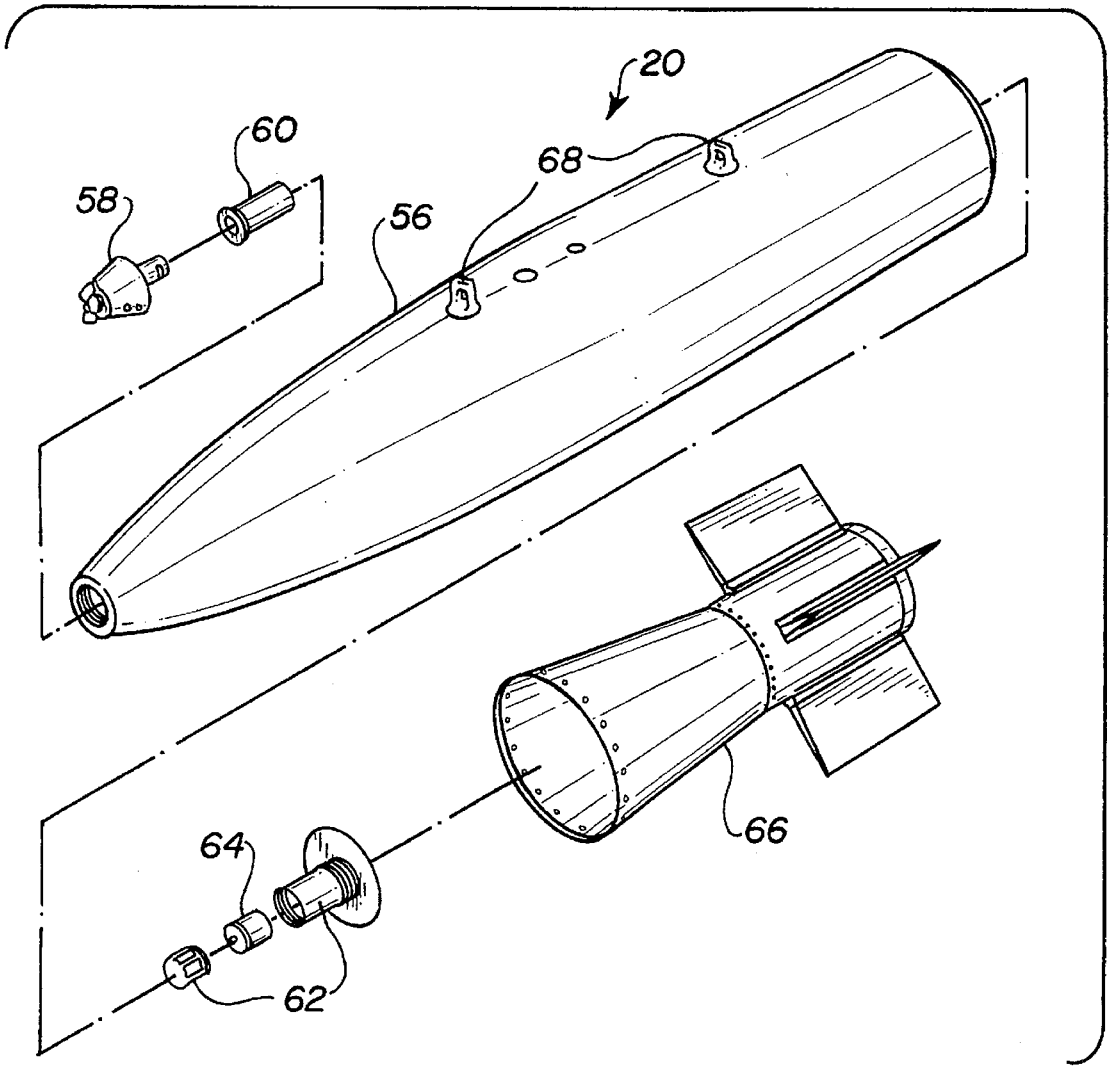
FIG. 6 PRIOR ART
FIG. 6 is an enlarged exploded perspective view of the prior art mine of FIG. 5.

Referring to FIGS. 5 and 6, the MK 64 Quickstrike ordnance 20 is a warhead weighing 1000 pounds. As well-known, the MK 64 ordnance 20 includes an elongated bomb case 56 also having an arming device 58 and booster 60 mounted at its nose end and a target detecting device 62 and battery 64 disposed in the bomb case 56. At the rear end of the bomb case 56 is supported a tail section 66. Also, a pair of axially displaced hook eyelets 68 are attached along the top of the bomb case 56.

Figure 7:
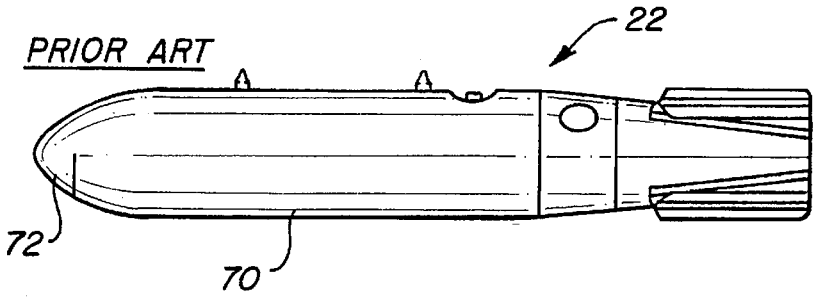
FIG. 7 PRIOR ART
FIG. 7 is a side elevational view of still another prior art mine adapted to provide the ordnance used in the method.
Figure 8:
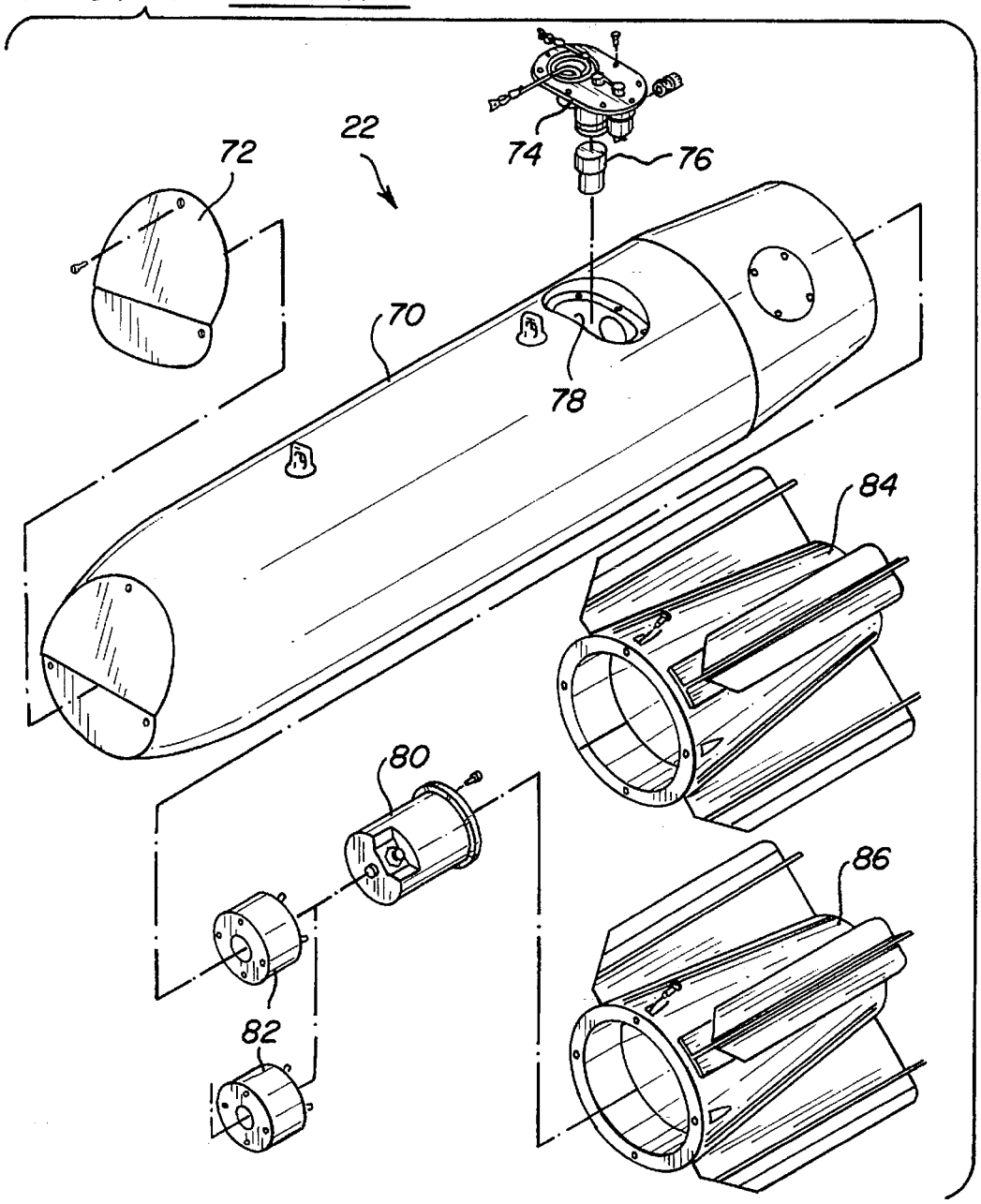
FIG. 8 PRIOR ART
FIG. 8 is an enlarged exploded perspective view of the prior art mine of FIG. 7.

Referring to FIGS. 7 and 8, the MK 65 Quickstrike ordnance 22 is a warhead weighing 1500 pounds. As well-known, the MK 65 ordnance 22 includes an elongated bomb case 70 having a nose fairing 72 attached at its nose end, and a safety device 74 and an arming device 76 mounted in the bomb case 70 through a top opening 78 therein. A target detecting device 80 and battery 82 are disposed in the bomb case 70 adjacent to the arming device 76. At the rear end of the bomb case 70 is supported one or the other of the tail sections 84, 86.

The MK 63/64/65 Quickstrike mines 18, 20, 22 all use a MK57 Target Detecting Device (TDD). For employment in the method of the present invention, the ordnance will have the MK57 TDD and associated logic circuits modified to receive the preselected magnetic signal and transform it into a firing signal in accordance with the steps of the detailed flow diagram of FIG. 12 which will be described below. No other changes are required to convert the Quickstrike mines 18, 20, 22 for employment in the method of the present invention.

Figure 9:
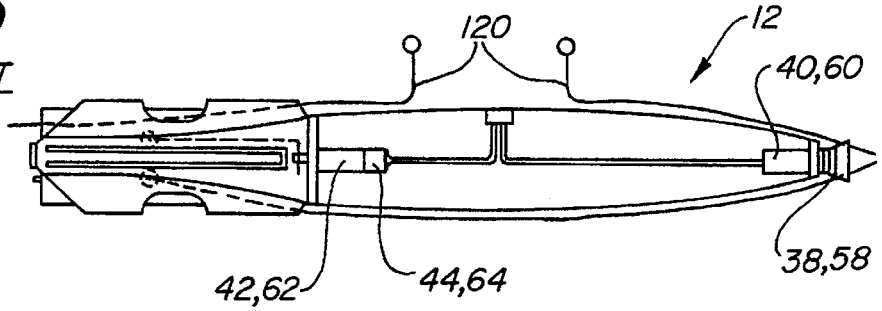
FIG. 9 PRIOR ART
FIG. 9 is a diagrammatic side elevational view of the one prior art mine of FIGS. 3 and 4.
Figure 10:
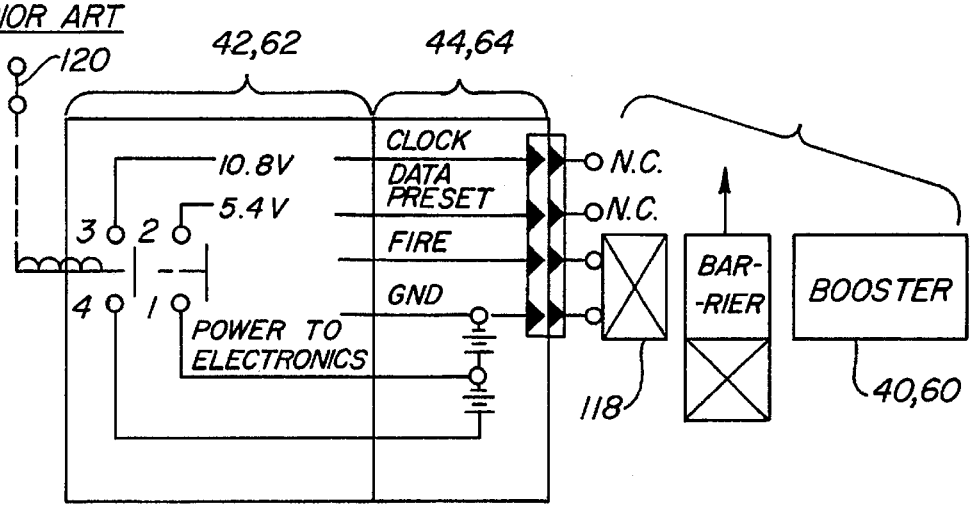
FIG. 10 PRIOR ART
FIG. 10 is a schematic of a circuit of a target detecting device on the mine of FIG. 9.
Figure 11:
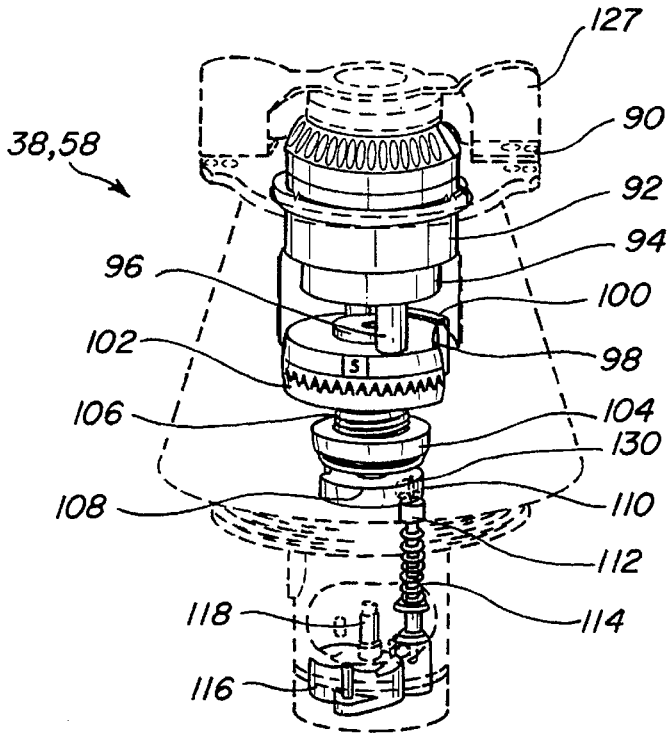
FIG. 11 PRIOR ART
FIG. 11 is an enlarged perspective view of an arming device of the prior art mine of FIGS. 3 and 4.

Referring now to FIGS. 9–11, there is illustrated respectively circuits of the prior art MK57 TDD 42, 62 and MK 130 battery 44, 64 and the prior art arming device 38, 58. As is well-known, the MK32 arming device 38, 58 includes a nose shear lug 90 overlying and supported on a governor and gear reduction system 92. The arming device 38, 58 also includes an arming stop 94 and arming stop fingers 96 alignable with a cutout 98 in a tab 100. The arming device 38, 58 further includes a striker body 102 overlying a blocker ring 104 with a spring 106 therebetween. A shear wire 108 and shear pin 110 are coupled to a plunger 112 of a rotor release assembly 114 which restrains a rotor 116 from rotation until shearing of the wire 108 and pin 110 occurs. Release and rotation of the rotor 116 arms the device 38, 58 by aligning a detonator 118 with the booster 40, 60.

Referring also to a detailed flow diagram of the method of the present invention, generally designated 122, in FIG. 12 together with FIGS. 9–11, upon release from the aircraft 26 as per block 124 of flow diagram 122, the Quickstrike converted MK63 and MK64 ordnance 18, 20 are armed by the aforementioned MK32 arming device 38, 58 located in the nose end of the ordnance. In particular, on release of the ordnance 12 from the aircraft 26, the fins stabilize its flight and the receiver (SCM) 88 is enabled, as per blocks 125, 126 of flow diagram 122, and the arming wire 120 is removed permitting a vane 127 to turn in response to the pressure of the flowing airstream, as per blocks 128, 129 of flow diagram 122. The vane 127 operates the governed gear train reduction system 92 which turns the interconnected striker body 102 and blocker ring 104. As the blocker ring 104 turns, a pocket 130 on the blocker ring 104 is brought into alignment with the plunger 112, as per block 132 of flow diagram 122, allowing the plunger 112 to partially release from the rotor 116. In addition, a ball is positioned in line with the striker body 102 and a stem. On impact as per block 134 of flow diagram 122, the nose assembly and striker body 102 are driven down against the ball and stem as per block 136 of flow diagram 122, shearing the wire 108 which releases the blocker ring 104 from the stem. The blocker ring 104 is pushed up by the plunger 112 which is then completely free of the rotor 116, as per block 138 of flow diagram 122, allowing the rotor 116 to turn and arm, as per blocks 140, 142 of flow diagram 122. This aligns the fuze detonator 118 with the remaining firing train components. A firing signal from the receiver 88, which has replaced the MK57 TDD, initiates the firing train in the arming device 38, 58, as per block 144 of flow diagram 122, to detonate the MK59 booster 40, 60, as per block 146, and subsequently fire the warhead, as per block 148.

Finally, referring again to the detailed flow diagram 122 of FIG. 12, the receiver 88 does not initiate the firing train until it receives the coded magnetic signal transmission from a standoff inductive transmitter 150 located at the standoff control station 34. Commercial off-the-shelf equipment are available and known by those of ordinary skill in this art to provide the transmitter 150 and receiver 88 which transmit and receive the coded magnetic signal.

When the magnetic signal (a coded magnetic flux transmission) is received from the remote transmitter 150, as per block 152 of flow diagram 122, and sensed by an induction sensor as per block 154 of flow diagram 122, the electrical signal produced in the receiver 88 is boosted in two stages, first, by a preamplifier stage as per block 156 and, second, by an amplifier stage as per block 158. The boosted signal is routed through a logic circuit in the receiver 88, as per block 160 of flow diagram 122, which decodes and recognizes the firing signal, as per block 162. The logic circuit of the receiver 88 then sends a firing signal, as per block 164 of flow diagram 122, to the arming device which, in turn, detonates the MK59 booster, as per block 146, and subsequently fires the ordnance warhead, as per block 148. If quantities of the ordnance 12 are present in the same area at the same time and have been coded to recognize the same magnetic firing signal, then all the emplaced ordnance will detonate simultaneously as determined by the response time of the firing circuit. On the other hand, if the logic circuit of the receiver 88 fails to recognize the firing signal, as per block 166 of flow diagram 122, then the signal is ignored, as indicated by block 168.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

For the purposes of this invention, the MK71 TDD (not shown) and MK75 arming device (not shown) may be interchangeable with the aforementioned MK57 TDD and the MK32 arming device.

We claim:

1. A method for air delivery of ordnance and clearing of explosive mines and obstacles from a navigable sea channel, said method comprising the steps of:

(a) providing quantities of ordnance adapted to survive impact with land and sea and prolonged immersion in sea water and to arm in response to air flow pressure and then detonate in response to receiving a preselected signal;

(b) delivering the quantities of ordnance through air toward multiple sites in a navigable sea channel containing obstacles and explosive mines so as to cause arming of the quantities of ordnance followed by impact thereof with the navigable sea channel and submersion and emplacement thereof at the multiple sites in the navigable sea channel; and (c) receiving the preselected signal at the emplaced quantities of armed ordnance so as to cause simultaneous detonation thereof and synergistic destruction of the obstacles and explosive mines in the navigable sea channel.

2. The method of claim 1 wherein the preselected signal is a magnetic signal.

3. The method of claim 1 wherein the quantities of ordnance are delivered by aircraft.

4. The method of claim 1 wherein the quantities of ordance are delivered from a standoff delivery platform.

5. The method of claim 1 further comprising:

delivering global positioning system markers with the quantities of ordnance to mark prior to detonation an amphibious path through the cleared navigable sea channel.

6. The method of claim 1 further comprising the step of:

transmitting the preselected signal to the emplaced quantities of armed ordnance.

7. The method of claim 6 wherein the preselected signal is an encrypted magnetic signal.

8. The method of claim 6 wherein the preselected signal is transmitted simultaneously to the emplaced quantities of armed ordnance.

9. The method of claim 6 wherein the preselected signal is transmitted from a standoff control station.

10. The method of claim 9 wherein the preselected signal is transmitted simultaneously to the emplaced quantities of armed ordnance.

11. The method of claim 10 wherein the preselected signal is a common magnetic signal transmitted to all the emplaced quantities of armed ordnance.

12. The method of claim 1 wherein the preselected signal is received so that the emplaced quantities of armed ordnance are detonated substantially simultaneously.

13. A method for air delivery of ordnance and clearing of explosive mines and obstacles from a navigable sea channel, said method comprising the steps of:

(a) providing quantities of ordnance adapted to survive impact with land and sea and prolonged immersion in sea water and to arm in response to air flow pressure and then detonate in response to receiving a magnetic signal transmitted to the ordnance from a standoff control station;

(b) delivering the quantities of ordnance through air toward multiple sites in a navigable sea channel containing obstacles and explosive mines so as to cause arming of the quantities of ordnance followed by impact thereof with the navigable sea channel and submersion and emplacement thereof at the multiple sites in the navigable sea channel;

(c) transmitting the magnetic signal from the standoff control station simultaneously to the emplaced quantities of armed ordnance; and (d) receiving the magnetic signal simultaneously at the emplaced quantities of armed ordnance so as to cause simultaneous detonation thereof and synergistic destruction of the obstacles and explosive mines in the navigable sea channel.

14. The method of claim 13 wherein the quantities of ordnance are delivered by aircraft.

15. The method of claim 13 wherein the quantities of ordance are delivered from a standoff delivery platform.

16. The method of claim 13 further comprising:

delivering global positioning system markers with the quantities of ordnance to mark prior to detonation an amphibious path through the cleared navigable sea channel.

* * * * *